US009991612B2

(12) United States Patent
Shaw et al.

(10) Patent No.: US 9,991,612 B2
(45) **Date of Patent: *Jun. 5, 2018**

(54) COAXIAL CONNECTOR SPLICE

(71) Applicant: PERFECTVISION MANUFACTURING, INC., Little Rock, AR (US)

(72) Inventors: Vincent Shaw, Lin'an (CN); Glen David Shaw, Conway, AR (US); Yiping Hu, Little Rock, AR (US)

(73) Assignee: PERFECTVISION MANUFACTURING, Inc., Little Rock, AR (US)

( * ) Notice: Subject to any disclaimer, the term of this patent is extended or adjusted under 35 U.S.C. 154(b) by 40 days.

This patent is subject to a terminal disclaimer.

(21) Appl. No.: 15/249,365

(22) Filed: Aug. 27, 2016

(65) Prior Publication Data

US 2016/0365652 A1 Dec. 15, 2016

Related U.S. Application Data

(63) Continuation of application No. 14/246,073, filed on Apr. 5, 2014, now Pat. No. 9,431,728.

(51) Int. Cl.

| | |
|---|---|
| ***H01R 13/62*** | (2006.01) |
| ***H01R 9/05*** | (2006.01) |
| ***H01R 24/54*** | (2011.01) |
| ***H01R 31/06*** | (2006.01) |
| *H01R 103/00* | (2006.01) |

(52) U.S. Cl.

CPC ..... *H01R 9/0503* (2013.01); *H01R 9/0521* (2013.01); *H01R 24/542* (2013.01); *H01R 31/06* (2013.01); *H01R 2103/00* (2013.01)

(58) Field of Classification Search

CPC ..... H01R 13/6395; H01R 17/12
USPC ..... 439/371, 583, 578, 675, 63, 825
See application file for complete search history.

(56) References Cited

U.S. PATENT DOCUMENTS

| | | | | |
|---|---|---|---|---|
| 3,757,279 | A | 9/1973 | Winston | |
| 5,242,316 | A | 9/1993 | Gartzke et al. | |
| 5,498,175 | A | 3/1996 | Yeh et al. | |
| 5,667,409 | A | 9/1997 | Wong et al. | |
| 5,730,622 | A | 3/1998 | Olson | |
| 5,746,619 | A * | 5/1998 | Harting | H01R 24/40 439/352 |
| 5,820,408 | A | 10/1998 | Wang | |
| 5,863,226 | A * | 1/1999 | Lan | H01R 9/0503 439/578 |
| 6,065,997 | A | 5/2000 | Wang | |
| 6,071,144 | A | 6/2000 | Tang | |
| 6,113,431 | A | 9/2000 | Wong | |
| 6,250,960 | B1 | 6/2001 | Youtsey | |
| 6,276,970 | B1 | 8/2001 | Wong | |
| 6,808,426 | B2 | 10/2004 | Liu | |
| 6,899,563 | B1 | 5/2005 | Lee | |
| 7,306,484 | B1 | 12/2007 | Mahoney et al. | |
| 8,083,544 | B2 * | 12/2011 | Chee | H01R 24/542 439/578 |
| 8,172,617 | B2 | 5/2012 | Peng | |

(Continued)

*Primary Examiner* — Phuong Chi T Nguyen
(74) *Attorney, Agent, or Firm* — Paul D. Chancellar; Ocean Law

(57) ABSTRACT

A coaxial cable connector splice including a central conductor extending between opposed ends and an insulating structure interposed between the central conductor and an outer body.

13 Claims, 9 Drawing Sheets

(56) References Cited

U.S. PATENT DOCUMENTS

| | | | |
|---|---|---|---|
| 8,298,020 | B1 | 10/2012 | Chen |
| 8,585,438 | B2 | 11/2013 | Tang |
| 2013/0102190 | A1 | 4/2013 | Chastain et al. |
| 2013/0115809 | A1 | 5/2013 | Hanson et al. |
| 2013/0244481 | A1 | 9/2013 | Holland et al. |
| 2013/0244509 | A1 | 9/2013 | Holland |

* cited by examiner

700A

700B

COAXIAL CONNECTOR SPLICE

PRIORITY CLAIM AND INCORPORATION BY REFERENCE

This application is a continuation of U.S. patent application Ser. No. 14/246,073 filed Apr. 5, 2014 entitled COAXIAL CONNECTOR SPLICE incorporated herein in its entirety and for all purposes.

BACKGROUND OF THE INVENTION

Coaxial cable connectors are well-known in various applications including those of the satellite and cable television industry. Coaxial cable connectors including F-Type connectors used in consumer applications such as cable television and satellite television are a source of service calls when service is disturbed by lost and/or intermittent coaxial cable connections typically involving a junction between a male F-type connector terminating a coaxial cable and a female F-type port located on related equipment.

FIELD OF INVENTION

This invention relates to the electromechanical arts. In particular, the invention provides an electrical connector suitable for terminating a coaxial cable having a center conductor and a ground conductor encircling the center conductor.

DISCUSSION OF THE RELATED ART

The problem of connecting or splicing two coaxial cables is known in the satellite and cable television industry. This connection problem has a well-known solution utilizing a coaxial connector to splice the cables. While known splices provide a connection between the cables, improved splices that are less susceptible to failure during installation are desirable. Further, splices with improved multiple use performance are also desirable.

SUMMARY OF THE INVENTION

The present invention provides coaxial cable connector splices. Various embodiments improve connector serviceability with features such as improved materials, improved geometry, enhanced splice pin crush resistance, enhanced coaxial center conductor retention, and enhanced electrical continuity.

Some embodiments of the present invention resist center conductor damage due to excessive axial compression forces. For example, if the coaxial cable is not prepared properly and fitted correctly inside a terminating connector such as a male F-connector, splice internal components including the center conductor can be forced inward and/or crushed when the F-connector is tightened onto the splice. Designs including a radially formed plastic sleeve prevent damage when unusual and excessive axial force is applied. And, prototypes show some designs utilizing this sleeve withstand at least 30 pounds of total axial pressure applied to plastic suspension collars at either end of the sleeve without collapsing or damaging the splice internal center conductor tube.

Some embodiments of the present invention enhance the grip or retention force the splice exerts on an inserted coaxial cable center conductor. Further, some designs use forces such as resilient forces of a) center conductor tube metal leaf contactors and/or b) flexible fingers such as flexible plastic fingers molded into suspension collar ends that suspend the conductor tube. Where the plastic parts, by themselves, fail to achieve satisfactory results and where manipulation or alternate designs of the metal center conductor tube contactors also fail to achieve satisfactory results, a combination of plastic parts and center conductor tube contactor modifications was found to achieve satisfactory results. In particular, some prototypes demonstrated compliance with Society of Cable Telecommunication Engineers ("SCTE") test standard ANSI/SCTE 146 2008, Section 2.2 concerning the center conductor tube retention after multiple insertions of a male center conductor.

Splice changes including addition of the plastic sleeve caused some prototypes to fail an SCTE test standard ANSI/SCTE 146 2008 for return loss. Section 3.3 of the standard requires a return loss of −30 dB or less.[1] Sleeve materials, sleeve dimensions and center conductor dimensions were varied to find combinations that met the test standard. In some embodiments, a center conductor tube outer diameter of about 1.84 mm and a sleeve made of ABS plastic provided a combination that, given other constraints, met the test standard.

Return Loss. Shall be no worse than 30 dB, when tested in accordance to ANSI/SCTE 04 1997, ANS Test Method for "F" Connector Return Loss or ANSI/SCTE 144 2007, Procedure for Measuring Transmission and Reflection.

BRIEF DESCRIPTION OF THE DRAWINGS

The present invention is described with reference to the accompanying figures. These figures, incorporated herein and forming part of the specification, illustrate embodiments of the present invention and, together with the description, further serve to explain the principles of the invention and to enable a person skilled in the relevant art to make and use the invention.

DETAILED DESCRIPTION OF THE PREFERRED EMBODIMENTS

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

As used herein, coupled means directly or indirectly connected by a suitable means known to persons of ordinary skill in the art. Coupled items may include interposed features such as, for example, A is coupled to C via B. Unless otherwise stated, the type of coupling, whether it be mechanical, electrical, fluid, optical, radiation, or other is provided by the context in which the term is used.

Figure 1A:
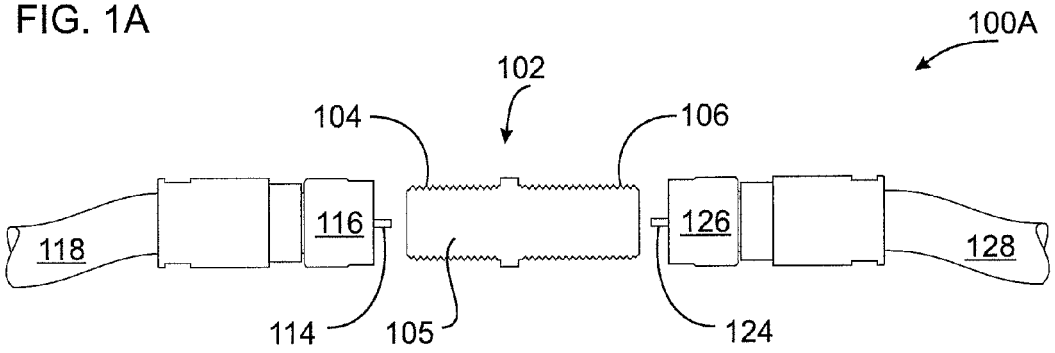
FIGS. 1A-C show schematic diagrams of a coaxial connector splice in accordance with the present invention.
Figure 1B:
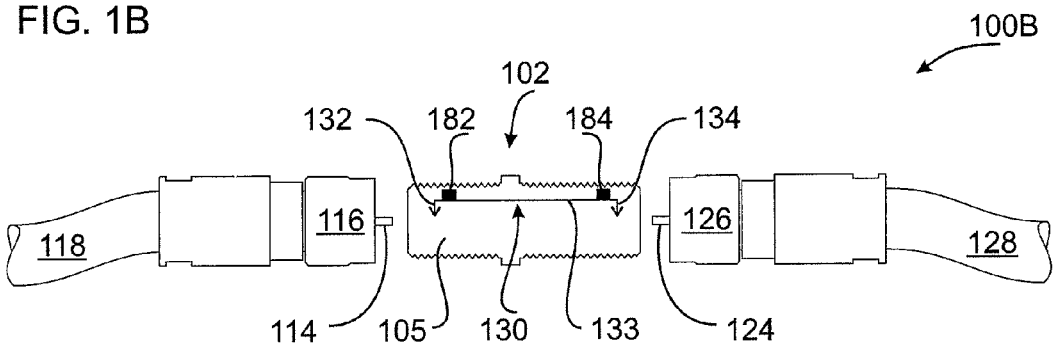
Figure 1C:
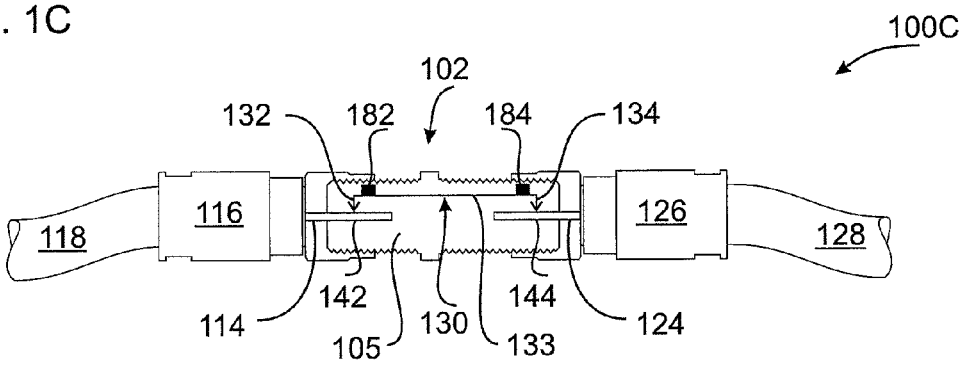

FIGS. 1A-C show schematic diagrams of a coaxial connector splice in accordance with the present invention 100A-C. In FIG. 1A, a splice 102 includes a body 105 with engagement features such as threads 104, 106 at opposed ends. Ready for splicing are coaxial cables 118, 128 terminated by respective connectors 116, 126.

In FIG. 1B, the center conductor 130 of the splice 102 is shown. The center conductor includes generally opposed coaxial cable center conductor contacts 132, 134 that are interconnected by a longitudinal conductor 133. The splice center conductor contacts are for making electrical contact with center conductors 114, 124 of respective coaxial cables 118, 128.

Skilled artisans will recognize the splice pin and the splice body are electrically isolated from each other by one or more insulating structures or supports such as center conductor end supports 182, 184. As such, all or part of the structure/support in the gap between the pin and the body is an electrical insulator. In various embodiments, these supports are made entirely or, in the alternative, partially of an electrical insulator providing this isolation. Notably, pin fabrication techniques include rolling sheet stock, forging, drawing, boring, and similar fabrication techniques. Typical pin materials include conductors such as copper and copper alloys.

In FIG. 1C, the attachment of cables 118, 128 to the splice 102 is completed. As shown, the connectors 116, 126 are attached at opposite ends 104, 106 of the splice 102. When the connectors are attached, the connector center conductors (the coaxial cable center conductor where appropriate F Type connectors are used) make electrical contact 142, 144 with respective internal splice contacts 132, 134 such that a signal path through the splice via the splice longitudinal conductor 133 is established. As skilled artisans will appreciate, signal ground also requires an electrical path such as an electrical path through an electrically conductive splice body 105.

Figure 2A:
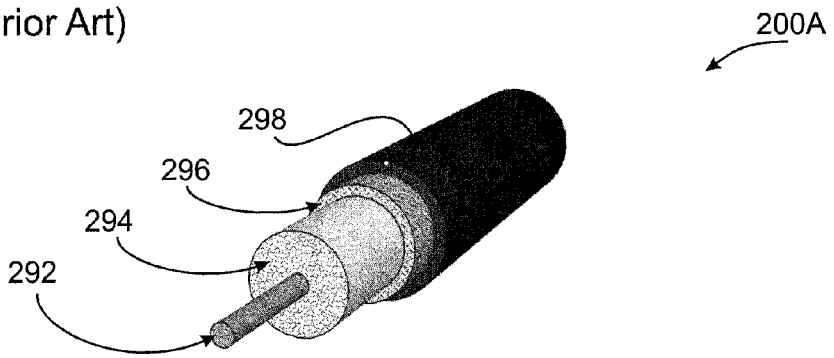
FIG. 2A (Prior Art)
FIG. 2A shows a prior art coaxial cable for use with splices of FIGS. 1A-C.

FIG. 2A shows a prior art coaxial cable 200A while FIGS. 2B-E distinguish proper coaxial cable preparation from improper coaxial cable preparation associated with splice pin compression failures 200B-E. In particular, FIGS. 2B-E illustrate splice installation failures addressed by some embodiments of the present invention.

FIG. 2A shows a perspective view of a prepared end of a coaxial cable 200A. At the cable center is a center conductor such as a copper wire 292. A second conductor or shield 296 surrounds the center conductor. The shield is conductive and may take the form of one or more of a wire braid or foil. For example, some coaxial cables employ a foil layer beneath a wire braid layer. Between the shield and center conductors is a dielectric material 294 and encasing the shield is a non-conducting outer jacket 298.

FIGS. 2B-C and 2D-E illustrate use of properly and improperly prepared coaxial cables 200B-C and 200D-E.

Figure 2B:
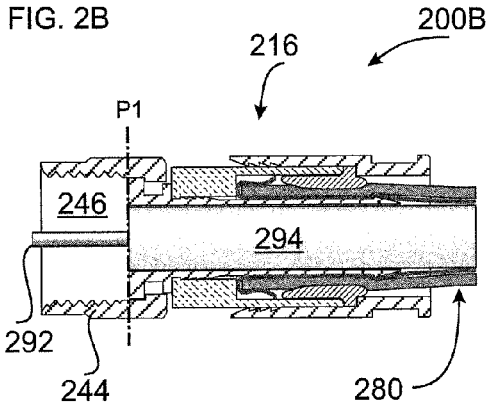
FIGS. 2B-E show splice pin compression effects of proper and improper coaxial cable preparation.

In FIG. 2B a properly prepared coaxial cable 280 terminated with an F Type connector 216 is shown 200B. Here, the coaxial cable dielectric 294 is trimmed to avoid interference with a mated splice, for example trimmed to P1 such that it does not protrude into the connector fastener 244 cavity 246.

Figure 2D:
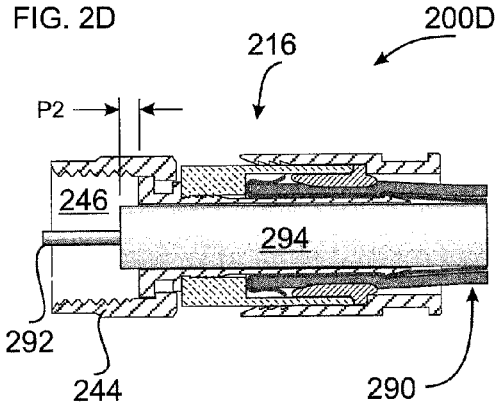
Figure 2C:
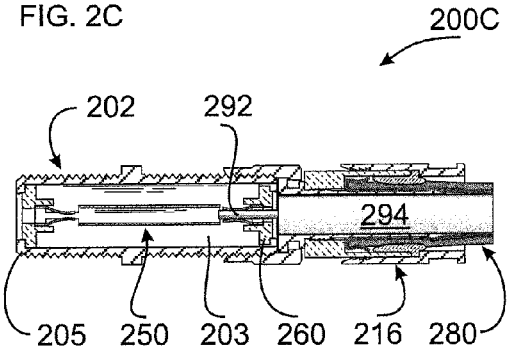

In FIG. 2C, the connector 216 terminating the properly prepared cable 280 is attached to a splice 202. The splice includes a splice body 205, a splice center pin 250 inside the body 203 and splice center pin supports 260.

As shown, assembly of the connector 216 with the splice 202 brings the coaxial cable dielectric 294 next to the splice center pin support 260. Proper dielectric trimming therefore avoids detrimental physical interference between the support and the dielectric.

In FIG. 2D an improperly prepared coaxial cable 290 terminated with an F Type connector 216 is shown 200D. Here, the coaxial cable dielectric 294 is trimmed such that it does not avoid interference with a mated splice, for example trimmed to P2 such that it does protrude into the connector fastener cavity 246.

Figure 2E:
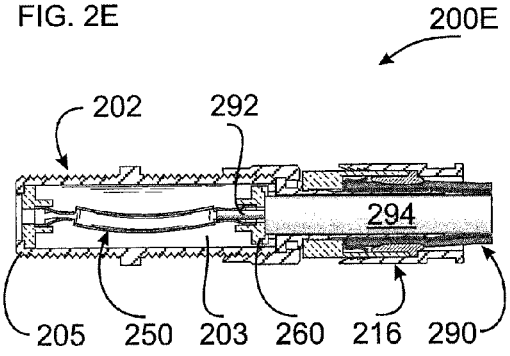

In FIG. 2E, the connector 216 terminating the improperly prepared cable 290 is attached to a splice 202. The splice includes a splice body 205, a splice center pin 250 inside the body 203, and splice center pin supports 260. As shown, assembly of the connector with the splice brings the coaxial cable dielectric 294 into interfering contact with parts of the splice, for example into interfering contact with a splice center pin and/or splice center pin support. Some may refer to unintended and/or detrimental axial forces from improperly trimmed (too long) dielectric as "dielectric push."

Interfering contact between cable dielectric 294 and internals of the splice such as the splice pin and/or a pin support 260 risks deformation of splice internals such as the splice pin 250. For example, FIG. 2E shows the splice pin in a deformed state due to improperly trimmed dielectric forcing the splice pin into a shorter span than its natural span. Other splice part deformations may also result including crushing, tearing, bending, kinking, collapsing and the like to either or both of the cable dielectric and splice internals.

Figure 3A:
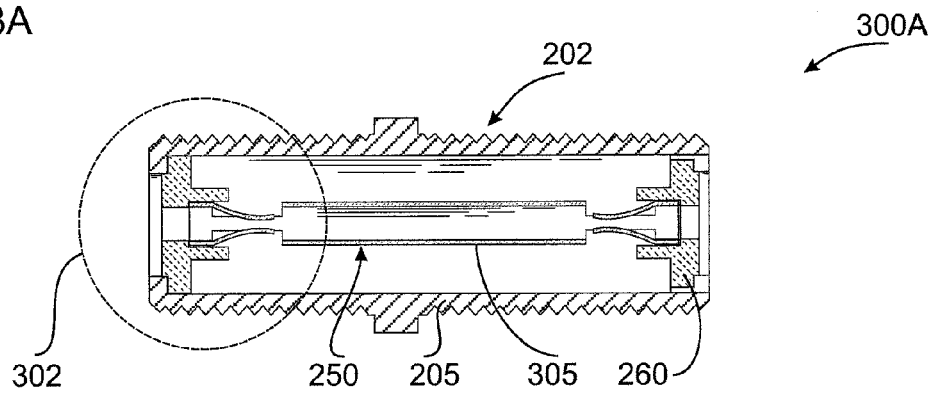
FIGS. 3A-C show an inner mouth splice pin for use with the connectors of FIGS. 1A-C.
Figure 3B:
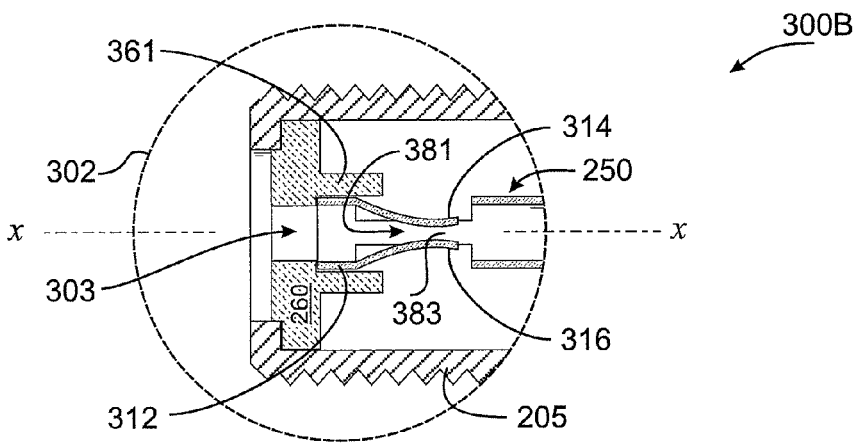
Figure 3C:
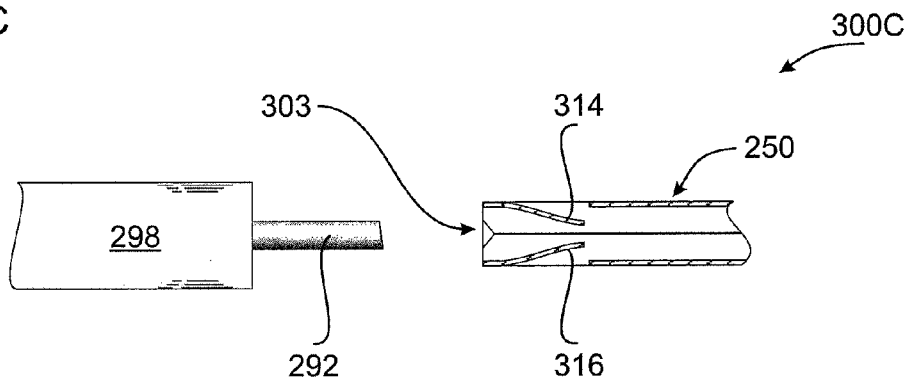
Figure 3D:
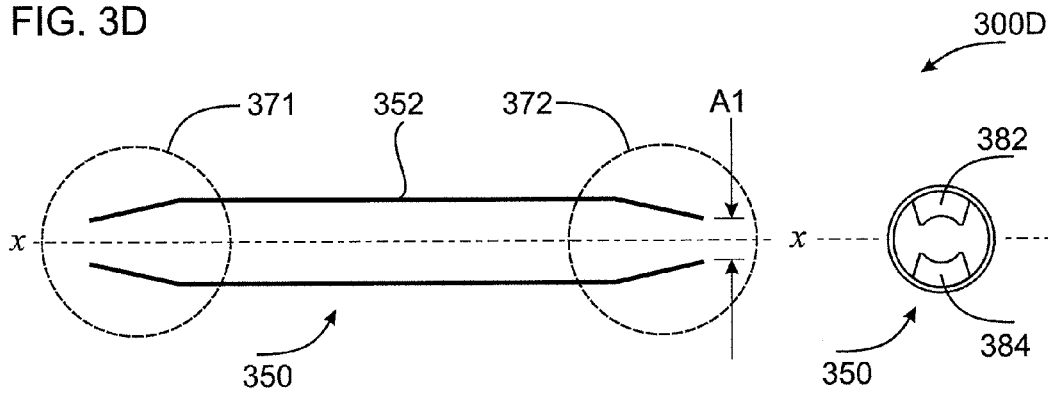
FIGS. 3D-F show an outer mouth splice pin for use with the connectors of FIGS. 1A-C.
Figure 3E:
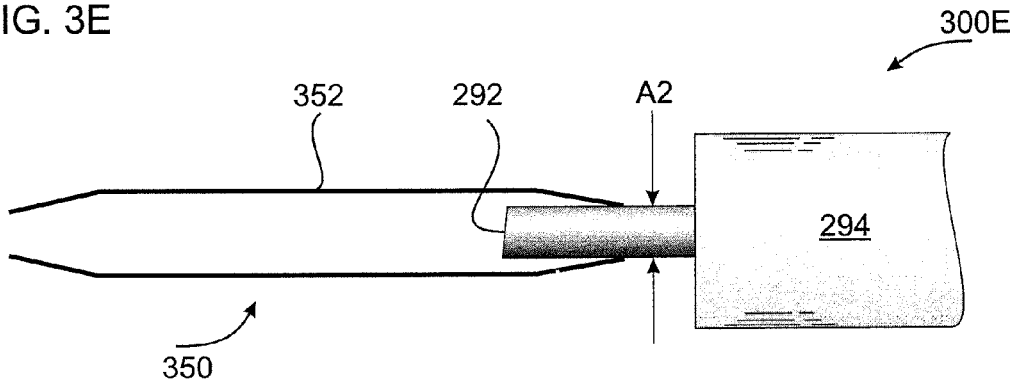
Figure 3F:
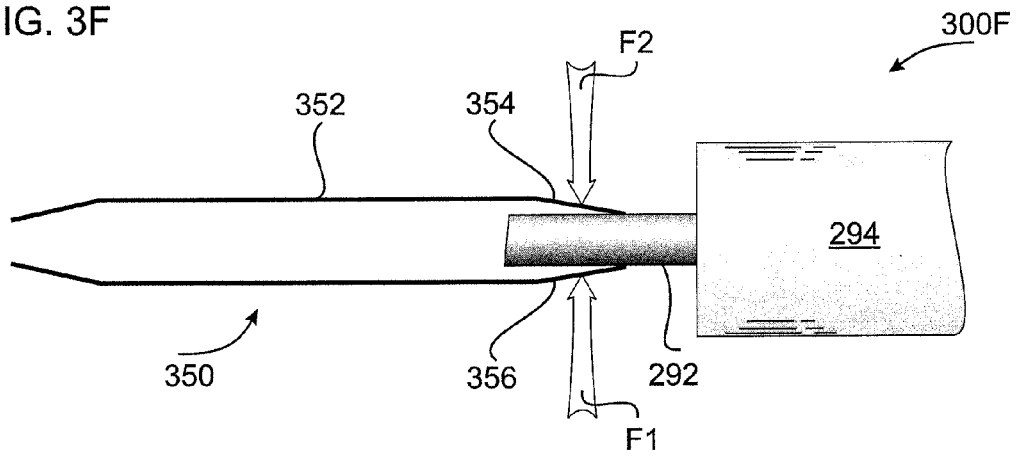

Among other things, splice pin mouth designs vary the grip of the splice pin on an inserted coaxial cable center conductor. FIGS. 3A-C show a splice pin with an inner mouth design 300A-C while FIGS. 3D-F show a splice pin with an outer mouth design 300D-F.

In FIG. 3A, a splice 202 includes a body 205, a splice pin 250, and pin supports 260 are shown. The splice body houses the splice pin that is supported by the pin supports. At the splice ends 302, means for engaging a coaxial connector such as an F-Type male coaxial cable connector is provided.

FIG. 3B shows an enlarged splice end 300B. Within the splice body 205, the splice pin support 260 holds the splice pin 250 via a splice pin hanger such as a tubular splice pin hanger 312. The splice pin hanger is inserted in a socket of the support 361.

Splice pin leaves, such as substantially opposed leaves 314, 316, extend from the splice pin hanger 312 with respective free ends reaching toward the middle of the splice pin 305 such that an inwardly directed mouth or inner mouth 381 is formed. The leaves are capable of flexing to form a variable passageway 383 for receiving a center conductor of a coaxial cable via a splice pin end hole 303.

FIG. 3C shows a portion of the splice pin 250 adjacent to the center conductor 292 of a coaxial cable 298. As skilled artisans will appreciate, insertion of the center conductor 292 into the variable passageway 383 flexes the leaves 314, 316. While the center conductor remains inserted, the leaves remain flexed in a manner urging engagement between the leaves and the center conductor.

Skilled artisans will understand that during insertion of the center conductor 292 between the leaves 314, 316 and while the center conductor remains inserted between the leaves, the leaves tend to develop a "memory" of their deformation such that when they are relieved by removal of the center conductor, they do not fully recover their original shape, but retain some permanent deformation.

Permanent leaf deformation tends to reduce the contact force or grip the leaves 314, 316 can exert when a coaxial cable center conductor 292 is reinserted. Reduced leaf contact force is frequently detrimental to the performance of the splice for reasons including increased electrical resistance between the splice pin 250 and the engaged coaxial cable center conductor.

FIGS. 3D-F show a splice pin with an outer mouth design 300D-F.

In FIG. 3D, a splice pin 350 includes a mid-section 352 adjoining opposing, outwardly directed pin mouths or outer mouths 371, 372. Dimensions A1 for accessing a pin mouth 372 are chosen such that the pin mouth engages an inserted coaxial cable center conductor 292 or a fixed center pin of a fixed pin connector. In some embodiments, the pin mouths are formed by a plurality of tines, e.g. 382, 384, angled toward a pin central axis x-x.

FIG. 3E shows the splice pin 350 with an inserted coaxial cable center conductor 292. The coaxial cable center conductor has a dimension A2 which is greater than pin mouth dimension A1 such that the pin mouth 372 is opened when the center conductor is inserted in the mouth. In some embodiments, a pin mouth entry feature such as a chamfer, curve, angle, flare, or similar feature eases center conductor insertion. As skilled artisans will now appreciate, features of the pin and pin mouth, including materials and geometries, provide for engagements such as a resilient engagement between the pin mouth and the center conductor.

FIG. 3F shows the splice pin 350 with an inserted coaxial cable center conductor 292. Here, forces such as somewhat opposing forces F1, F2, are applied to the pin mouth 372. In an embodiment, forces are applied to inwardly sloped sides of the pin mouth 354, 356 tending to close the pin mouth around the center conductor of a coaxial cable. For example, when a coaxial cable center conductor is inserted in the pin mouth, the forces tend to improve the grip of the pin on the center conductor by holding the pin mouth and/or pin mouth tines 382, 384 against the center conductor.

Figure 4A:
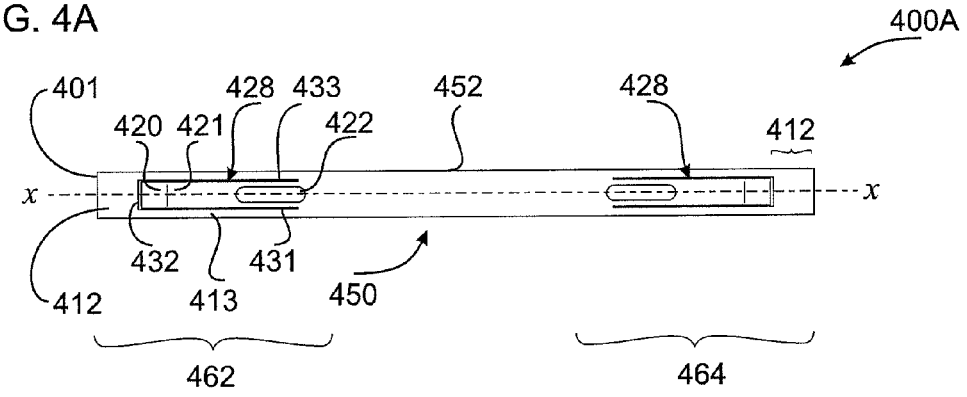
FIGS. 4A-F show another outer mouth splice pin for use with the connectors of FIGS. 1A-C.
Figure 4B:
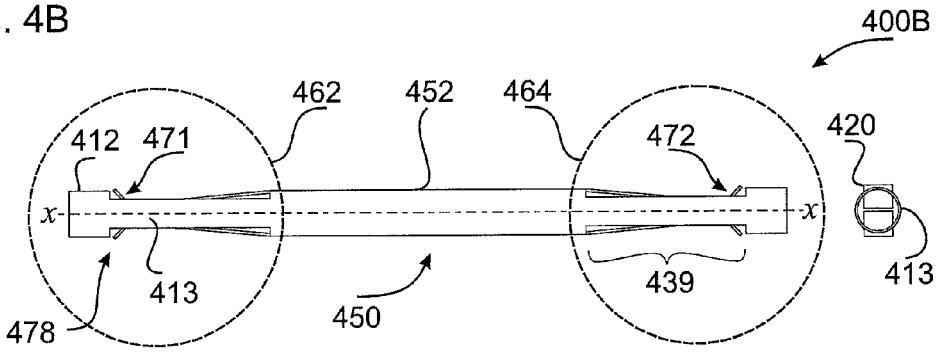
Figure 4C:
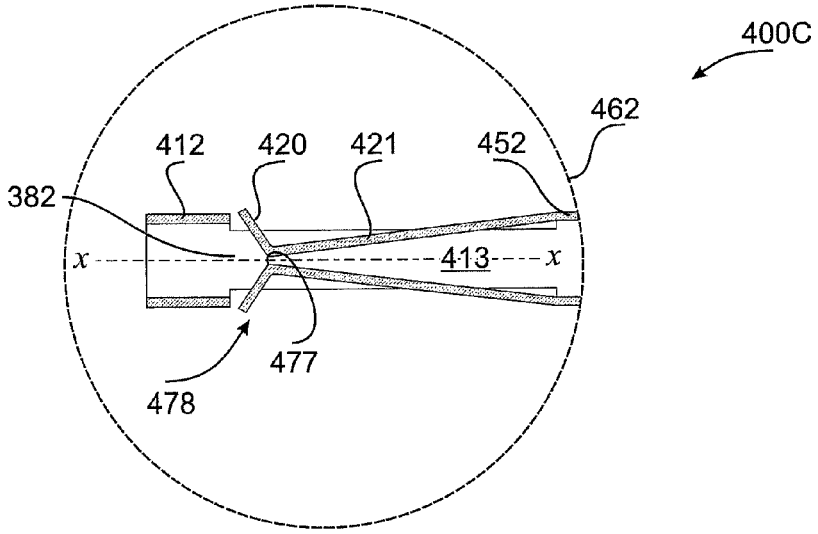

FIGS. 4A-C show another outer mouth splice pin 400A-C. As seen in FIG. 4A, the splice pin 450 includes opposed pin end sections 462, 464 joined by a pin middle section 452. An exemplary pin end section includes a hanger such as a tubular hanger 412, a contactor 478, and a pin mouth 471. The contactor defines an aperture 382 for receiving the center conductor of a coaxial cable.

The contactor 478 is formed by plural tongues 428 extending from the pin middle section 452 and forming opposed outwardly directed mouths 471, 472. Tongue flexing varies the aperture size 382 to accommodate insertion of a coaxial cable center conductor such as the center conductor 292 of the coaxial cable of FIG. 2A. An exemplary tongue 428 is formed when somewhat "U" shaped cut lines define a flexible arm. For example, FIG. 4A shows three cut lines 431, 432, 433 in the pin 450. Cut lines 431 and 433 are substantially parallel to a pin axis x-x and an adjoining cut line 432 proximate a pin entry end 401 is about perpendicular to the pin axis.

Figure 5A:
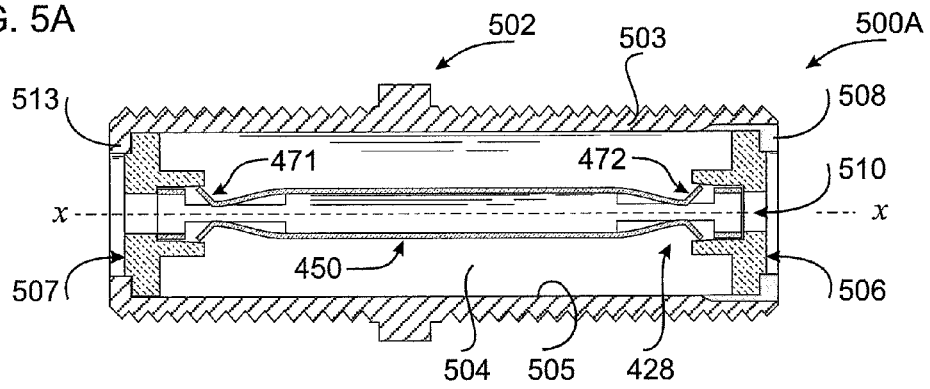
FIGS. 5A-D show an embodiment of the splices of FIGS. 1A-C that includes an outer mouth splice pin.
Figure 5B:
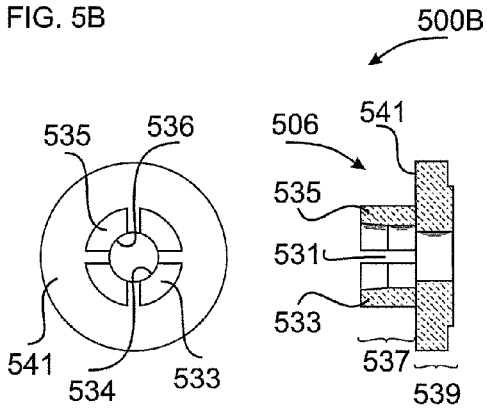
Figure 5C:
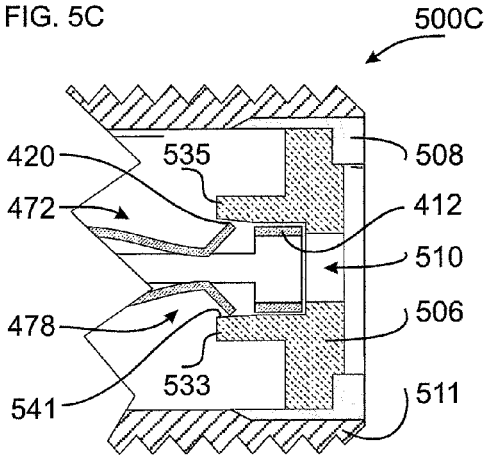
Figure 5D:
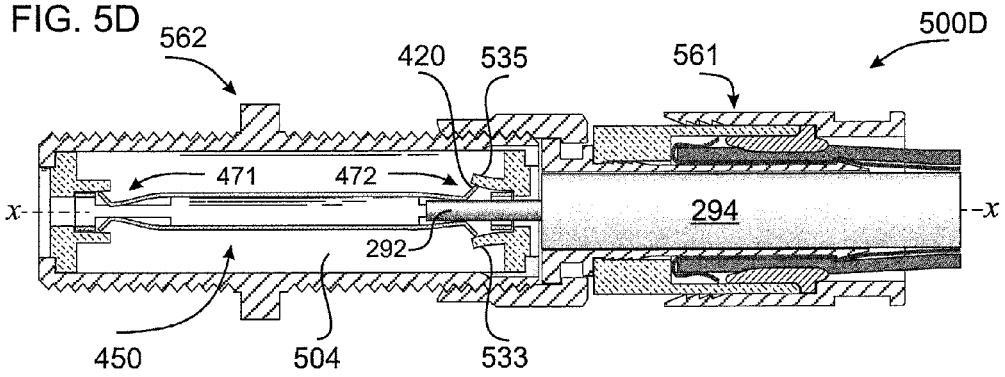

Tongue electrical contact portions 477 face the pin longitudinal axis x-x and are for engaging the coaxial cable center conductor 292 (see. e.g., FIG. 5D). For example, a coaxial cable center conductor may be inserted in the pin 450 via an end section entry 401 in the hanger 412.

In some embodiments, opposed tongues 428 with opposed contacts 477 provide a contactor 478 for engaging the center conductor of a coaxial cable 292. Some tongues include a tongue tip 420 bent away from a pin longitudinal axis x-x such that a contact 477 is formed where the tip is bent away from a tongue base 421 extending between the tongue tip and the pin middle section. As indicated by a bump such as an elongated longitudinal surface feature 422, tongue modifications like tongue surface modifications may be used to adjust tongue and/or tongue base stiffness. Features suited to one or more embodiments include holes, embossments, and amendments such as ribs.

And, in some embodiments, interconnecting structure such as a strut(s) 413 extends between the pin hanger 412 and the pin middle section 452. As shown, the struts define a slot 439 in which the tongues move to accommodate a coaxial cable center conductor 292. Skilled artisans will appreciate that embodiments of the splice pin 450 may be formed using multiple techniques. Examples include sheet stock rolled into a tube, seamless tubes of various cross-sections, and multiple parts, tubular and otherwise that are joined to complete the pin.

As mentioned, pins may have multiple tongues 428. Further, tongues may have none, one, or more than one deformation such as one or more surface bumps.

Figure 4D:
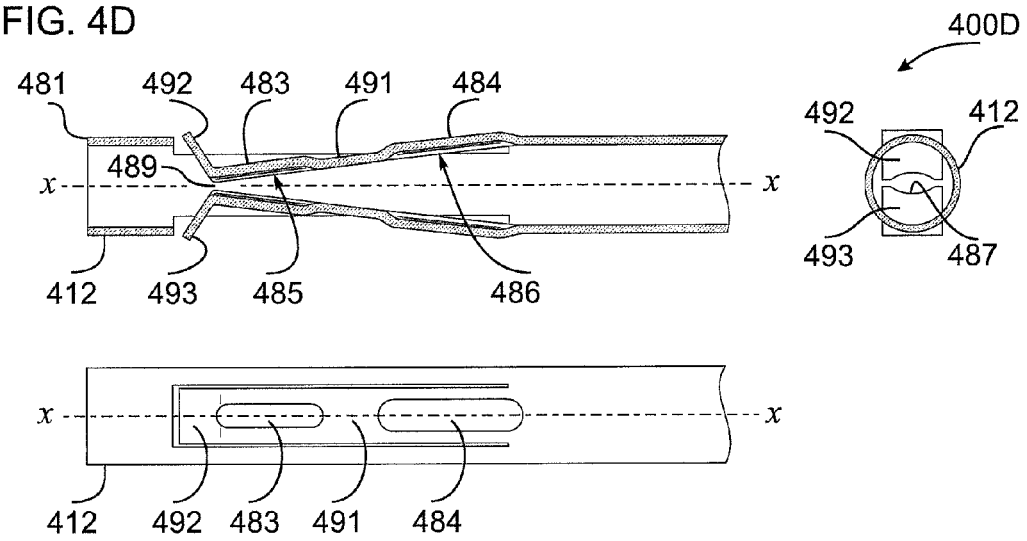

FIG. 4D shows a two tongue pin end with plural deformations 400D. In the figure, views of the pin end section are rotated about the longitudinal x-x axis to show the tongue from above and to show the tongue from the side along with an end view of the pin.

Here, there are two tongues 492, 493 projecting from slots behind a tubular hanger 412. One or more of the tongues have plural tongue deformations. As shown, there are exemplary deformations 483, 484 on the upper tongue 492. In various embodiments, the tongues form respective cavities 485, 486 facing the pin longitudinal axis x-x. And, in some embodiments a region of lesser tongue deformation 491 separates the raised portions of the deformations.

Where easing insertion force of a coaxial cable center conductor is desired, the tongue deformations 483, 484 may be designed to reduce insertion force. In an exemplary embodiment with one or more deformations, the leading deformation 483 may be designed with a cavity 485 that passes the center conductor via an enlarged aperture 489.

Surface contact and electric current carrying capacity between a coaxial center conductor and the tongues 492, 493 may also be improved using tongue deformations. For example, the tongue deformations 483, 484 may be designed with a shape curved around an axis parallel to the longitudinal axis x-x such that one or more respective cavities 485, 486 form structure(s) 487 similar to saddle(s) that contact the center conductor around a larger portion of the conductor circumference.

Tongue deformations 483, 484 that curve, roughen, or otherwise increase the sectional modulus of the tongue provide a stiffer tongue more resistant to being bent away from the longitudinal axis x-x. For example one or more deformations that extend longitudinally will urge the center conductor more forcefully toward the longitudinal axis x-x and against opposing tongue(s). Tongue deformations may be substantially the same. Or, tongue deformations may be of differing magnitudes being longer, wider, or deeper. For example, one deformation may be longer than another for increasing center conductor surface contact area in a tongue region that accommodates the longer length. And, one deformation may be wider than another to ease center conductor entry.

Figure 4E:
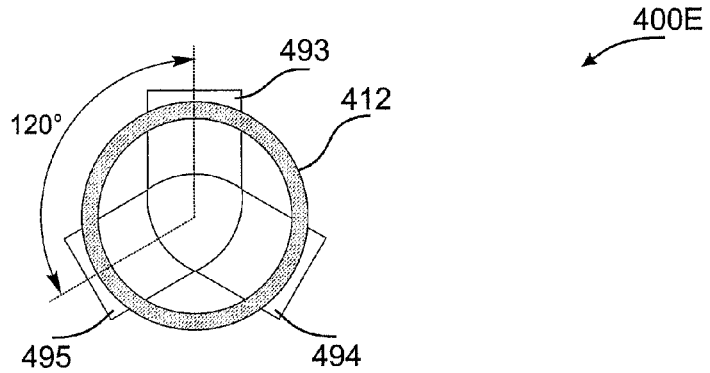
Figure 4F:
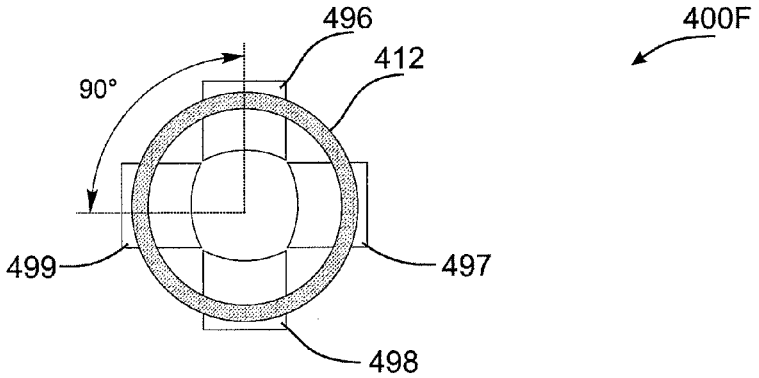

FIGS. 4E and F show end views of a pin with multiple tongues 400E, 400F. In FIG. 4E, a three tongue 493-495 end is shown where the three tongues project from respective slots behind the tubular hanger 412. As shown, tongue centerlines are equally spaced around an azimuth at 120 degree angles. In other embodiments the tongues are not equally spaced but, for example, may be spaced to accommodate tongues of differing dimensions. In FIG. 4F, a four tongue 496-499 pin end is shown where the four tongues project from respective slots behind the tubular hanger 412. As shown, tongue centerlines are equally spaced around an azimuth at 90 degree angles.

FIGS. 5A-D show a splice with an outer mouth splice pin 500A-D. FIG. 5A shows a splice 502 including an outer mouth splice pin 450. The splice pin is located in a splice body 503 interior 504. The splice pin is carried by end supports 506, 507 spanning between the pin and the body inside surface 505. Coaxial cable center conductor passages at opposing ends of the splice 510 provide a means for engaging the center conductors with the splice pin. In various embodiments, an integral splice body shoulder 513 retains a support at one end of the body 507 while a body end seat at an opposite end of the body 511 is for receiving a shoulder ring 508 that retains the second support 506.

The supports 506, 507 include face plates 539 with annular back faces 541. The face plate adjoins a central socket 537 that is adapted to hold respective center pin hangars 412. In various embodiments, the socket has projections such as tines or fingers 533, 535 formed by socket sidewall slots 531.

In various embodiments, bumpers such as tongue tips 420 engage the inside surface(s) of the socket such as the inside surfaces 534, 536 of socket tines 533, 535. And, in various embodiments the socket inside surface(s) is inwardly tapered to provide for guided entry of parts such as the hanger and/or tongue tips into the socket.

As skilled artisans will recognize, insertion of a coaxial cable into a pin mouth 471, 472 via a splice center conductor passage 510 tends to separate generally opposed tongues 428. Contact forces between the socket 537 and the tongue tips 420 such as contact between socket tines 533, 535 and tongue tips 420 resist separation of the tongues and therefore strengthen the grip of the tongues on the coaxial cable center conductor 292. Similarly, socket forces tend to restore the tongues to their original position when the coaxial cable center conductor is removed from the splice 502.

The splice 562 and attached coaxial cable connector 561 of FIG. 5D show a coaxial cable center conductor 292 inserted in the mouth of a pin 472 such that support socket tines 33, 535 are deflected by tongue tip 420 forces that the tines resist. As shown at the opposite end of the splice, removal of the coaxial cable center conductor restores the pin mouth 471 to its original shape as the pin mouth and the socket tines move closer to the splice centerline x-x.

Figure 6A:
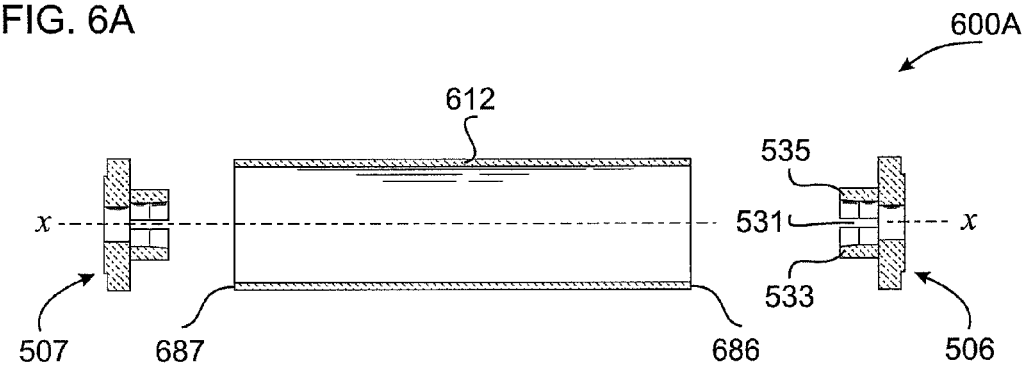
FIGS. 6A-C show an embodiment of the splices of FIGS. 1A-C that includes an outer mouth splice pin and a crush resistant sleeve.
Figure 6B:
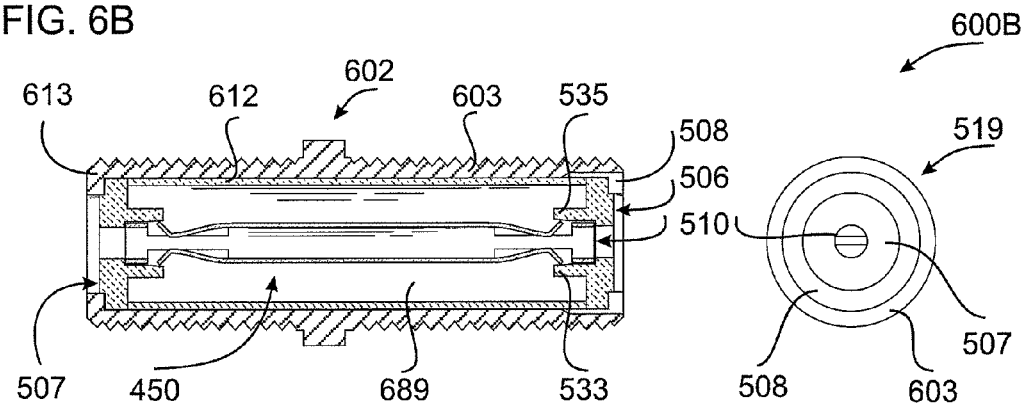
Figure 6C:
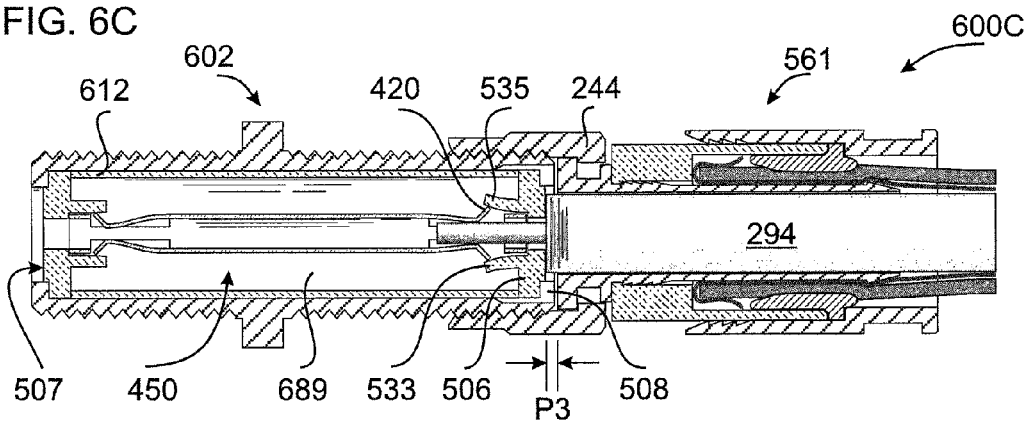

FIGS. 6A-C show a compression protected splice 600A-C. As seen in FIG. 6A, the pin supports 506, 507 abut a compressive load bearing member such as a compression brace at opposed brace ends 686, 687. Exemplary compressive load bearing members include sleeves, posts, and similar members suited to bearing such loads. The compressive load bearing member shown in FIG. 6A is a sleeve 612.

In some embodiments the sleeve 612 and the two pin supports 506, 507 are separate parts and in some embodiments the sleeve 612 incorporates one of the supports. Whatever the case, the sleeve 612 is designed to bear loads imposed by the pin supports 506, 507 located near either end of the sleeve. As discussed above, these loads may result from improper coaxial cable preparation such as excess cable dielectric length that pushes against pin supports when the coaxial cable connector 561 is tightened onto the splice 602.

When the sleeve is installed in a splice, the pin supports are separated by the sleeve as shown in FIG. 6B. In particular, compressive forces tending to buckle or otherwise deform the pin 450 are borne, at least initially, by the sleeve 612 that encircles the pin.

In the splice end view 519 of FIG. 6B, the center conductor passageway 510 is formed in the support 506 which is encircled by the shoulder ring 508 which is encircled by the splice body 603. During assembly of one embodiment of the splice 602, a first end support 507, pin 450, and sleeve 612 are inserted at least partially in the body cavity 689 followed by insertion of a second end support 506 and shoulder ring 508. Skilled artisans will appreciate variations of this embodiment that provide similar means to secure parts within a splice body 603 and/or assemble splice parts.

Compression sleeve benefits are illustrated, at least in part, by FIG. 6C. As seen, improper coaxial cable dielectric trimming results in dielectric 294 that projects P3 into the connector fastener 244 cavity 246 (see FIG. 2D). When, as here, the fastener is tightened onto the splice 602, the protruding dielectric pushes on the pin support 506. However, unlike pins damaged by compression in unprotected designs (see FIG. 2E), embodiments of protected designs of FIGS. 6A-C include a sleeve 612 that preferentially bears the compressive load and prevents pin damage. In various embodiments, the sleeve preferentially bears loads tending to distort the pin.

Skilled artisans will observe that sufficiently large compressive loads will fail even the protective sleeve 612. Applicant also observes that loads applied by mis-trimmed dielectric have led to industry specifications requiring protection of the pin 450 against loads up to about 30 pounds. Such loads can be accommodated by thin-walled plastic cylinders that fit within F Type coaxial cable connector splices such as F-81 type splices.

Figure 7A:
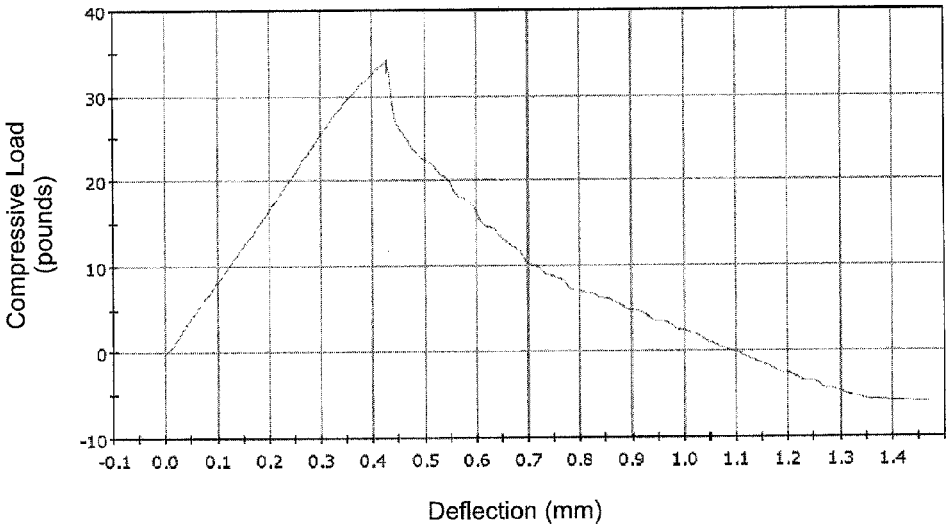
FIG. 7A shows load bearing performance of an embodiment of the splices of FIGS. 1A-C.

FIG. 7A is a chart illustrating a compression test to failure for an exemplary splice of the present invention. Here, the splice tested is similar to the one of FIG. 6B. For containment of internal parts, this splice utilizes a body shoulder at one end 613 and an insertable shoulder ring 508 at the opposite end. As shown on the figure, maximum load and failure occurs at about 35 pounds of compressive force. In this test, the compressive force is applied to the pin support adjacent to the body shoulder and the "failure" indicated by the figure occurs when the insertable shoulder ring is forcible ejected from the body 603. Yet another failure is deformation of the pin 450 such as pin bowing and/or pin collapse.

In various embodiments, the splice 602 of FIGS. 6B-C incorporates 1) a sleeve protecting the splice pin from excessive compressive force and 2) an outer mouth sleeve pin 450 with tongue tips 420 flexibly restrained by support tines 533, 535. Applicant notes this combination of features provides 1) protection against pin compression damage and 2) enhanced grip of the pin mouth 471, 472 on an inserted coaxial cable center conductor 292 as explained above (see e.g., FIGS. 5A-C).

While resisting pin compression damage and improving pin grip are both desirable features, implementing both in a coaxial cable connector splice upsets time tested splice geometries and materials known to provide an acceptable return loss. Applicant has therefore implemented and tested features of the present invention in a number of prototypes to identify embodiments that meet or substantially meet 30 pounds of compression withstand and −30 dB or less return loss.

Figure 7B:
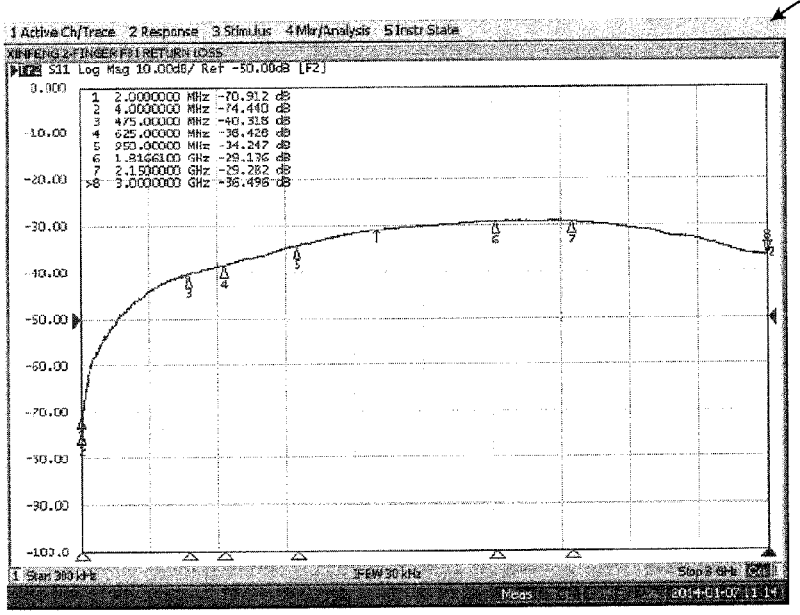
FIG. 7B shows return loss performance of an embodiment of the splices of FIGS. 1A-C.

Experiments showed that sleeves made of polymers such as plastics provided the desired resistance to deformation when subjected to compressive loads in the range of 30 pounds. In particular plastics including polyethylene ("PE"), polyoxymethylene ("POM"), and Acrylonitrile butadiene styrene ("ABS") were tested. FIG. 7B shows a return loss chart resulting from testing one prototype utilizing ABS plastic. As seen, return loss values for this prototype in the frequency range of 2 MHz to 3 GHz are in the range of −74.440 to −29.136 dB, values substantially meeting SCTE standards.

While several plastics provided acceptable load bearing capabilities, it was found that ABS plastic provided not only the required strength, but also the required dielectric properties. In particular, plastics generally increase dielectric constant and lower impedance. A means of offsetting this lowered impedance is to utilize a splice pin of a smaller diameter which tends to raise impedance as distance between the splice pin and splice body increases.

In an exemplary embodiment of a coaxial cable splice including a splice pin and a sleeve, the following specifications provided a splice that substantially met a 30 pound load bearing capacity requirement and a −30 dB or less return loss requirement.

| Parameter | Specification |
|---|---|
| 1. Sleeve material | ABS plastic |
| 2. Sleeve outer diameter | 6.8 mm (+/−0.05 mm) |
| 3. Sleeve inner diameter | 4.0 mm (+/−0.05 mm) |
| 4. Sleeve pin material | Conductor such copper alloy |
| 4. Pin outer diameter range | 1.84-2.0 mm (+/−0.05 mm) |

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A coaxial connector comprising:
- a pin supported within a body;
- the pin having opposed end sections joined by a pin middle section;
- each end section spaced away from the body by a pin support;
- a compression brace within the body, the compression brace preferentially bears forces on the pin supports that tend to compress the pin;
- in each end section, a proximal contactor and a distal pin hanger;
- the contactor including a variable aperture formed by tongues extending from the middle section; and,
- the contactor for receiving the center conductor of a coaxial cable that is for insertion into the pin via a fixed aperture formed by a pin hanger.

2. The connector of claim 1 further comprising resilient fingers configured to urge the tongues toward a pin central axis when the center conductor of a coaxial cable connector enters the variable aperture.

3. The connector of claim 2 wherein the resilient fingers project from the pin supports.

4. A coaxial connector splice comprising:
- a cylindrical center pin with a longitudinal seam;
- the pin having opposed end sections joined by a pin middle section;
- each end section including a proximal contactor and a distal pin hanger;
- each contactor including a variable aperture formed by tongues extending from the middle section;
- each contactor for receiving the center conductor of a coaxial cable;
- the center conductor for insertion into the pin variable aperture via a fixed aperture formed by a pin hanger;
- the pin hangers encircled by respective insulating structures; and,
- a compression brace within a splice body;
- wherein the compression brace is for preferentially bearing forces urging the insulating structures closer together.

5. The connector of claim 4 further wherein one or more of the tongues has a surface bump forming an opposing surface cavity that faces a pin longitudinal axis and conforms to a coaxial cable center conductor.

6. A coaxial connector method comprising the steps of:
- providing a seizing pin within a body, the pin having a first end section;
- providing in the end section a proximal contactor and a distal pin hanger, the contactor having tongues;
- each tongue defined by three pin sidewall slots;
- the contactor seizing a coaxial cable center conductor when insertion of the conductor between the tongues urges spreading of the tongues which is resisted by resilient fingers configured to restrain tongue movement;
- providing a pin second end section opposite the pin first end section, the second end section including a proximal contactor and a distal pin hanger;
- providing a pin middle section between the first and second end sections, the first end contactor tongues extending from the middle section and second end contactor tongues extending from the middle section;
- positioning the resilient fingers around the first end contactor; and,
- centering the first pin end in the body via a first insulator affixed to the body;
- wherein the first insulator incorporates the resilient fingers.

7. The method of claim 6 further comprising the steps of:
- centering the second pin end in the body via a second insulator; and,
- providing a compression brace within the splice body;
- wherein the compression brace preferentially bears forces urging the first insulator to move closer to the second insulator.

8. The method of claim 6 further comprising the step of forming the distal pin hanger as a tube.

9. A coaxial connector comprising:
- a pin supported by spaced apart first and second insulators, the insulator spacing being fixed;
- the pin having a middle section flanked by left and right end sections;

in the left end section, a first portion of the pin forming a contactor tongue and a second portion of the pin surrounding the tongue;

a slotted tongue boundary between the first and second pin portions for enabling tongue deflection for contacting a coaxial cable center conductor inserted in the pin;

in the right end section, a third portion of the pin forming a contactor tongue and a fourth portion of the pin surrounding the tongue;

a slotted tongue boundary between the third and fourth pin portions for enabling tongue deflection for contacting a coaxial cable center conductor inserted in the pin;

a plurality of contactor tongues in the first end section; and, resilient fingers surrounding the first end section contactor, the resilient fingers resisting tongue deflection away from the pin centerline when a coaxial cable center conductor is inserted in the pin.

10. The connector of claim 9 further comprising a compression brace within the splice body.

11. The connector of claim 10 wherein the compression brace preferentially bears forces urging the first insulator to move closer to the second insulator.

12. The connector of claim 11 wherein the left end section terminates with a pin hanger.

13. The connector of claim 12 wherein the pin hanger is formed as a tube.

* * * * *